US006220780B1

(12) United States Patent
Schindler et al.

(10) Patent No.: US 6,220,780 B1
(45) Date of Patent: Apr. 24, 2001

(54) APPARATUS FOR TRANSLOCATING LANE DIVIDER

(75) Inventors: Robert J. Schindler, Lakeland; Marshall L. Douberly, Homeland, both of FL (US)

(73) Assignee: Qwick Kurb, Inc., Lakeland, FL (US)

( * ) Notice: Subject to any disclaimer, the term of this patent is extended or adjusted under 35 U.S.C. 154(b) by 0 days.

(21) Appl. No.: 09/379,870

(22) Filed: Aug. 24, 1999

Related U.S. Application Data

(60) Provisional application No. 60/097,920, filed on Aug. 25, 1998.

(51) Int. Cl.[7] ..... E01C 23/05

(52) U.S. Cl. ..... 404/6; 404/9; 404/72; 404/84.2; 404/84.5

(58) Field of Search ..... 404/6, 9, 12, 84.05, 404/84.2, 84.5, 72

(56) References Cited

U.S. PATENT DOCUMENTS

| | | | |
|---|---|---|---|
| 4,017,200 | 4/1977 | Woods, Jr. . | |
| 4,500,225 | 2/1985 | Quittner . | |
| 4,624,601 | 11/1986 | Quittner . | |
| 4,653,954 | 3/1987 | Booth et al. . | |
| 4,955,753 | 9/1990 | McKay . | |
| 5,074,704 | 12/1991 | McKay . | |
| 5,246,305 | 9/1993 | Peek . | |
| 5,253,951 | 10/1993 | Peek . | |
| 5,688,071 | 11/1997 | Owen . | |
| 5,720,572 | 2/1998 | Richer . | |
| 6,022,168 * | 2/2000 | Junker | 404/6 |

* cited by examiner

*Primary Examiner*—Eileen D. Lillis
*Assistant Examiner*—Raymond W Addie
(74) *Attorney, Agent, or Firm*—Frijouf, Rust & Pyle, P.A.

(57) ABSTRACT

An apparatus and method is described for translocating a lane divider from an initial position to a final position on a roadway. The apparatus comprises a conveyor connected to a vehicle. The conveyor includes a receiving segment for receiving the lane divider from the initial position on the roadway and a discharging segment for discharging the lane divider to the final position on the roadway. The receiving segment and the discharging segment are pivotally connected relative to one another. The receiving segment may be pivoted to enable the lateral movement of the receiving segment to accommodate for variation in the initial position of the lane divider on the roadway. The discharging segment may be pivoted for discharging the lane divider to a final position aligned on the roadway. A translocating segment may be interposed between the receiving segment and the discharging segment for moving the lane divider from one lane to another lane on the roadway.

19 Claims, 13 Drawing Sheets

Prior Art

APPARATUS FOR TRANSLOCATING LANE DIVIDER

CROSS-REFERENCE TO RELATED APPLICATIONS

This application claims benefit of U.S. Patent Provisional application Ser. No. 60/097,920 filed Aug. 25, 1998. All subject matter set forth in provisional application Ser. No. 60/097,920 is hereby incorporated by reference into the present application as if fully set forth herein.

BACKGROUND OF THE INVENTION

1. Field of the Invention

This invention pertains to lane dividers for roadways and more specifically, to an apparatus and method for laterally translocating lane dividers from one position on a roadway to another. The apparatus and method may be used for adjusting the position of the lane dividers on the roadway or may be used for moving the lane dividers from one lane to another lane on the roadway.

2. Background of the Invention

Lane dividers are presently utilized in a number of roadway applications. Most commonly, lane dividers are utilized in road construction and alter the number of lanes extending to and from urban areas on a multiple lane highway depending on the time of day and anticipated traffic flow.

For example, in a six-lane roadway, four lanes will be utilized to transport traffic into an urban area during morning hours. The other two lanes will be utilized to transport traffic out of the urban area. During the evening hours, four lanes will be used to transport traffic out of the urban area and two lanes will be used to transport traffic into the urban location. Accordingly, the lane dividers had to be moved for the morning traffic and had to be moved for the evening traffic.

A first type of lane divider is heavyweight and cumbersome for acting as a barrier. These heavyweight and cumbersome barriers provided impact resistance in the event that a driver inadvertently steers a vehicle into a lane of oncoming traffic.

A second type of lane divider is a more lightweight lane divider and is commonly used in situations where traffic moves at a slower rate such as a construction zone or a low speed roadway. Initially, the lightweight lane dividers were moved manually by a crew of workmen as often as twice a day. Subsequently, a number of vehicles have been developed to laterally transport the lightweight lane dividers from one lane to another. Many of these vehicles for laterally transporting the lightweight lane dividers from one lane to another are awkward to use and are extremely wide. Many of these vehicles for laterally transporting the lightweight lane dividers from one lane to another occupied a substantial portion of an oncoming lane during the operation of the vehicle.

Many of the vehicles for laterally transporting the lightweight lane dividers from one lane to another have certain problems associated with an uneven lateral transfer. Frequently, the lightweight lane dividers laterally transported by the vehicles are not exactly discharged to be parallel to the initial position of the lightweight lane divider location. In many instances, the vehicles discharged the lightweight lane divider in a slightly curved manner. When the slightly curved lightweight lane dividers in a slightly curved position were transferred multiple times, the curvature was amplified by the multiple transfer by the vehicle.

The magnified curvature of the inappropriately placed lightweight lane divider became a driving hazard and had to be manually moved to a correct alignment.

U.S. Pat. No. 4,017,200 discloses a barrier for placement intermediate to two adjacent highway lanes and an apparatus for transferring the barrier from a location intermediate two lanes to a location intermediate two other lanes so as to accommodate differing traffic flow patterns for different times of day and different traffic conditions.

U.S. Pat. No. 4,500,225 discloses a roadway lane divider comprised of a plurality of interconnected divider sections each having a T-shaped upper end. Rollers of a mobile transfer apparatus are adapted for engagement under a pair of longitudinally extending undercut bearing surfaces, defined on the upper end of each divider section, to lift and suspend the divider sections as a unit on a first side of the apparatus, move them serpentine-like across the apparatus and deposit the divider sections on a second, opposite side of the apparatus.

U.S. Pat. No. 4,624,601 discloses transferable roadway lane dividers which consist of individual sections hingedly joined together. The lane dividers are picked up from one side of the lane by a transfer device mounted beneath a vehicle or trailer, traveling along the center of the lane, and are slid along the transfer device and are continuously deposited on the roadway at the desired new position on the other side of the lane.

U.S. Pat. No. 4,653,954 discloses an apparatus for moving laterally a traffic control barrier having a plurality of pivotally linked sections. The transfer vehicle includes means for picking up the sections on one side and depositing them on the other side as it moves along the roadway. The vehicle has front and rear guide drums around which the sections are moved through the vehicle in an S-shaped path and there are means for varying the space between the axes of the guide drums to compensate for disparity in lengths of the lane dividers around a curved roadway.

U.S. Pat. No. 4,955,753 teaches a roadway barrier system which provides a safe separation between opposing lanes of vehicular traffic and is capable of being moved across a lane to change the direction of traffic flow in the lane. A plurality of barrier sections are positioned end-to-end along one side of the lane, and a vehicle which travels along the lane has a transfer beam in the form of a figure-8 with a portion of the beam extending diagonally across the lane for transferring the barrier sections from one side of the lane to the other as the vehicle travels along the lane. Hinged connections between the barrier sections permit the sections to be positioned different distances apart and at different angles relative to each other, and striations on the side faces of the barrier sections help to prevent vehicles which contact the barrier sections from climbing over the barrier.

U.S. Pat. No. 5,074,704 discloses a roadway barrier system which provides a safe separation between opposing lanes of vehicular traffic and in some embodiments is capable of being moved across a lane to change the direction of traffic flow in the lane. In one disclosed embodiment, side plates bridge the gaps between the ends of adjacent barrier sections and provide a continuous surface along the sides of the sections. In some embodiments, striation panels help dissipate the energy of vehicles which contact the barrier and to assist in preventing such vehicles from bouncing off or climbing over the barrier.

U.S. Pat. No. 5,246,305 provides a mobile transfer and transport vehicle adapted to move a barrier system, having a plurality of interconnected and closely spaced modules, on a roadway or the like. The vehicle includes a conveyor having series of guide and support rollers for engaging, supporting, lifting and transferring the barrier system from a first side of said vehicle to a second side thereof. At least some of the rollers are spring-biased into engagement with the modules when they move through curved portions of a serpentine-like transfer path through the conveyor.

U.S. Pat. No. 5,253,951 discloses a mobile transfer and transport vehicle adapted to move a barrier system, having a plurality of pivotally interconnected and closely spaced modules, on a roadway or the like. The vehicle includes a conveyor having series of guide and support rollers for engaging, supporting, lifting and transferring the barrier system from a first side of the vehicle to a second side thereof. A drive system is mounted on the conveyor for frictionally engaging the modules to either pull or retard movement of the modules through the conveyor. The drive system aids in maintaining proper spacing between the modules, particularly when they are moved on a curved roadway.

U.S. Pat. No. 5,688,071 discloses a method of transferring a plurality of road elements. The method includes the steps of arranging a plurality of roller units on each of the road elements substantially centrally of each road element, pivotally connecting end portions of the adjacent road elements with one another, engaging the roller units of the road elements by a guiding element having a channel shape and two ends spaced from one another in a longitudinal direction and in a transverse direction, so that the roller units guidingly move inside the guiding element along the guiding element from one of the ends to the other of the ends and at the same time slightly pivot relative to one another, so that the road elements are transferred from a location at one end of the guiding element to the location at the other end of the guiding element.

U.S. Pat. No. 5,720,572 provides successive road elements of a road barrier. A partition or the like are turnable relative to one another by means of hinge elements connected to their facing walls. They can be transferred by a device having a substantially C-shaped hollow guiding element with opposite ends spaced from one another in a transverse direction, and a plurality of carts each having a substantially vertical shaft articulately connected with two successive road elements in the area of the two successive road elements, so that when the guiding element is longitudinally displaced, the carts are displaced inside the guiding element without engagement of the road elements with the guiding element, and the carts with the successive road elements are transferred from the area of one end to the area of the other end of the guiding element transversely.

Although the aforementioned vehicles have contributed to the lane divider art, none of the above-mentioned devices solve the problems discussed above which are presently faced in lateral displacement of roadway lane dividers.

Therefore, it is an object of the present invention to provide an apparatus for laterally translocating a lane divider from an initial position to final position on a roadway that accurately laterally translocates a lane divider from the initial position to the final position on the roadway.

Another object of the present invention to provide an apparatus for laterally translocating a lane divider from an initial position to final position on a roadway that automatically translocates the lane divider without the use of excessive and costly manual labor.

Another object of the present invention to provide an apparatus for laterally translocating a lane divider from an initial position to final position on a roadway without occupying an oncoming lane during the operation of the vehicle.

Another object of the present invention to provide an apparatus for laterally translocating a lane divider from an initial position to final position on a roadway wherein the final position is parallel to the initial position.

Another object of the present invention to provide an apparatus for laterally translocating a lane divider from an initial position to final position on a roadway wherein the final position is displaced at least one lane relative to the initial position on the roadway.

Another object of the present invention to provide an apparatus for laterally translocating a lane divider from an initial position to final position on a roadway wherein the final position is aligned in the same lane as the initial position on the roadway.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved apparatus and method for translocating a lane divider from an initial position to a final position on a roadway. The apparatus comprises a conveyor connected to a vehicle. The conveyor includes a receiving segment for receiving the lane divider from the initial position on the roadway and a discharging segment for discharging the lane divider to the final position on the roadway. The receiving segment and the discharging segment are pivotally connected relative to one another. The receiving segment may be pivoted to enable the lateral movement of the receiving segment to accommodate for variation in the initial position of the lane divider on the roadway. The discharging segment may be pivoted for discharging the lane divider to a final position aligned on the roadway. The discharging segment may be pivoted for discharging the lane divider to a final position aligned in the same lane as the initial position on the roadway.

In a more specific example of the invention, a translocating segment is interposed between the receiving segment and the discharging segment for moving the lane divider from one lane to another lane on the roadway. The laterally translocation of the lane divider from the initial position to the final position on a roadway is displaced at least one lane relative to the initial position on the roadway.

In another specific example of the invention, the apparatus comprises a generally serpentine-shaped conveyor connected to a vehicle. The conveyor includes a receiving segment, a discharging segment, and a translocating segment. The receiving segment receives the lane divider from the initial position on the roadway. The discharging segment discharges the lane divider to the final location on the roadway. The translocating segment connects the receiving and discharging segments. The receiving segment and translocating segment are pivotally connected to one another so as to enable the lateral movement of the receiving segment to accommodate for variation in the initial positioning of the lane divider and to allow for the centered receipt of the lane divider onto the receiving segment.

The conveyor may further comprise a plurality of spaced rollers that assist in transporting the lane divider down the conveyor. The rollers may be disposed on both the sides and the bottom of the conveyor. The rollers facilitate the movement of the lane divider along the conveyor.

The pivoting of the receiving segment relative to the translocating segment may be activated by an optical sensor that automatically detects the initial position of the lane divider relative to the receiving segment. In the alternative, the pivot assembly for pivoting the receiving segment relative to the translocating segment may be manually activated by an operator.

The translocating segment and discharging segment may be pivotally connected to allow greater precision in discharging the lane divider to the final position on the roadway. The discharging segment may be pivoted with respect to the translocating segment for providing greater precision in discharging the lane divider. The pivoting of the discharging segment may be activated by an optical sensor that detects the location of the lane divider relative to the discharge segment. In the alternative, the pivot assembly for pivoting the discharge segment relative to the translocating segment may be manually activated by an operator.

The translocating segment may be pivoted with respect to the receiving and discharge segments so as to control the lane divider translocation distance. The pivoting of the translocating segment controls the lane width distance from an initial lane position to a final lane position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated that the conception and the specific embodiments disclosed may be readily utilized as a basis for modifying or designing other structures for carrying out the same purposes of the present invention. It also should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
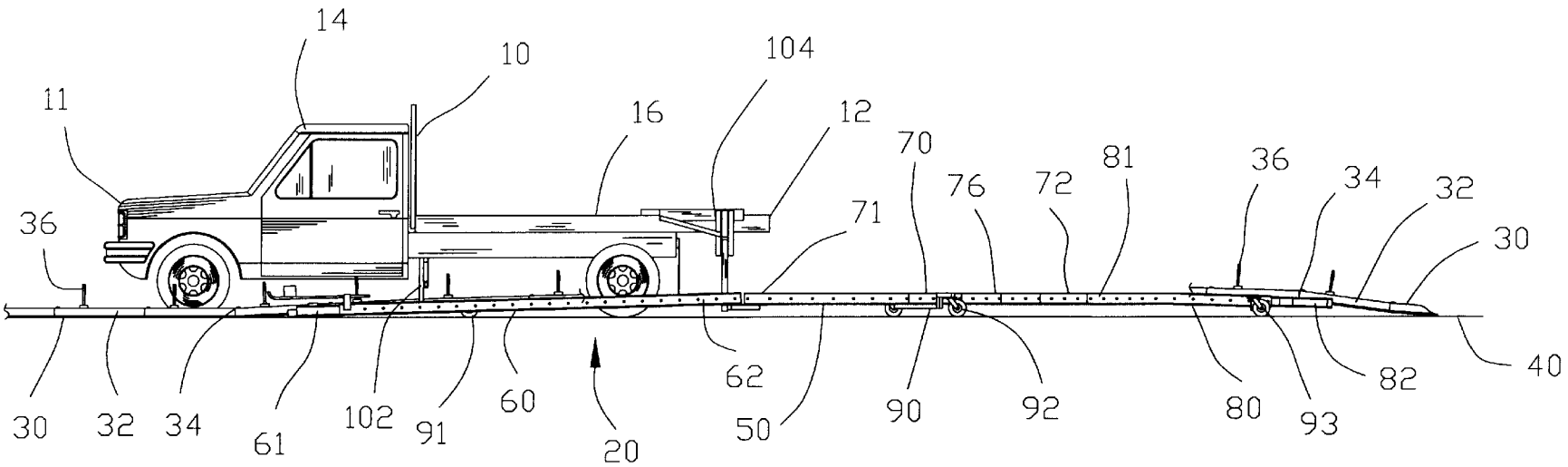
FIG. 1 is a side view of a prior art apparatus for laterally moving lane dividers from an initial position location to final position.
Figure 2:
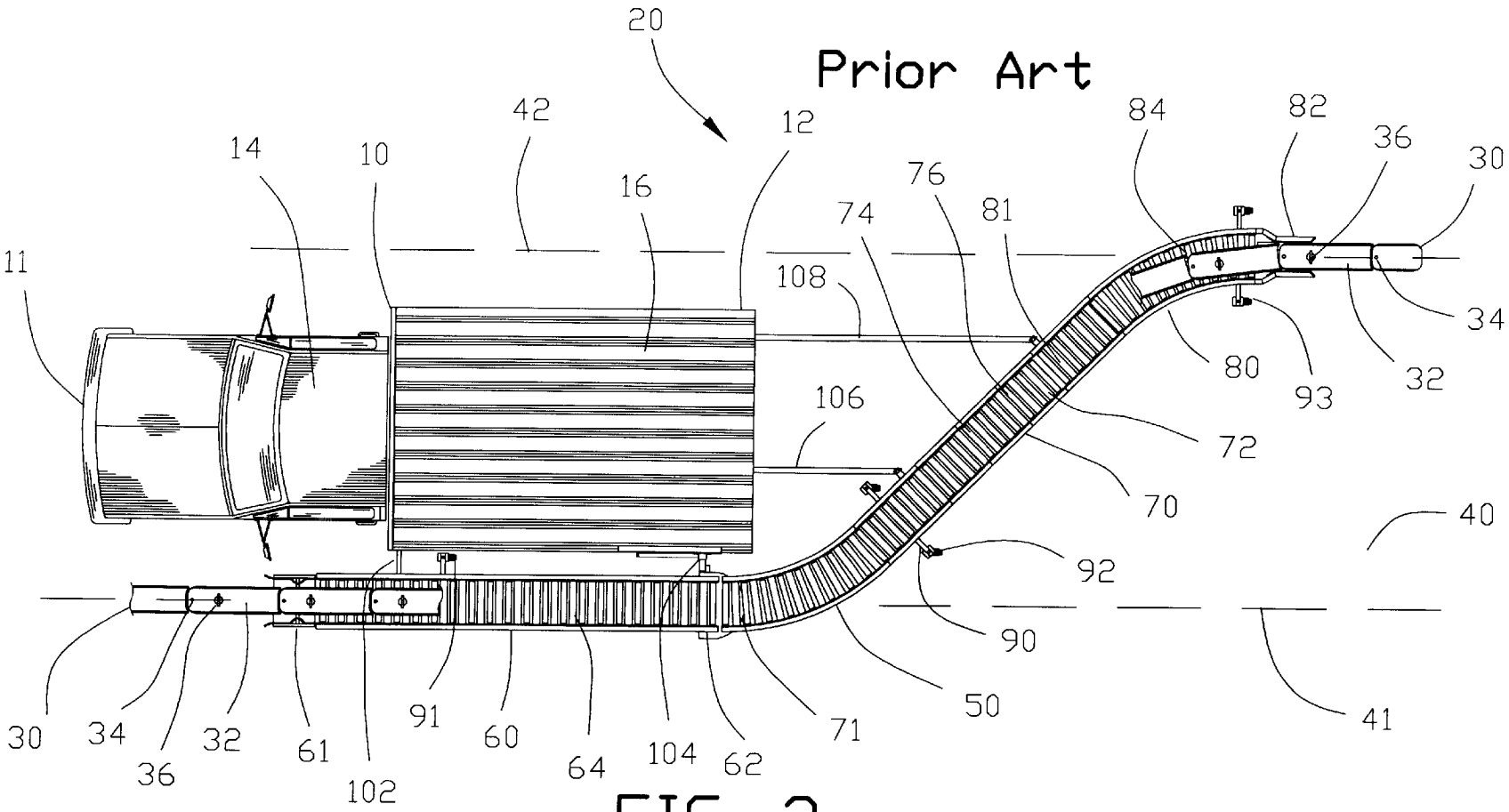
FIG. 2 is a top view of the prior art apparatus of FIG. 1 illustrating a wide lateral displacement of lane dividers.
Figure 3:
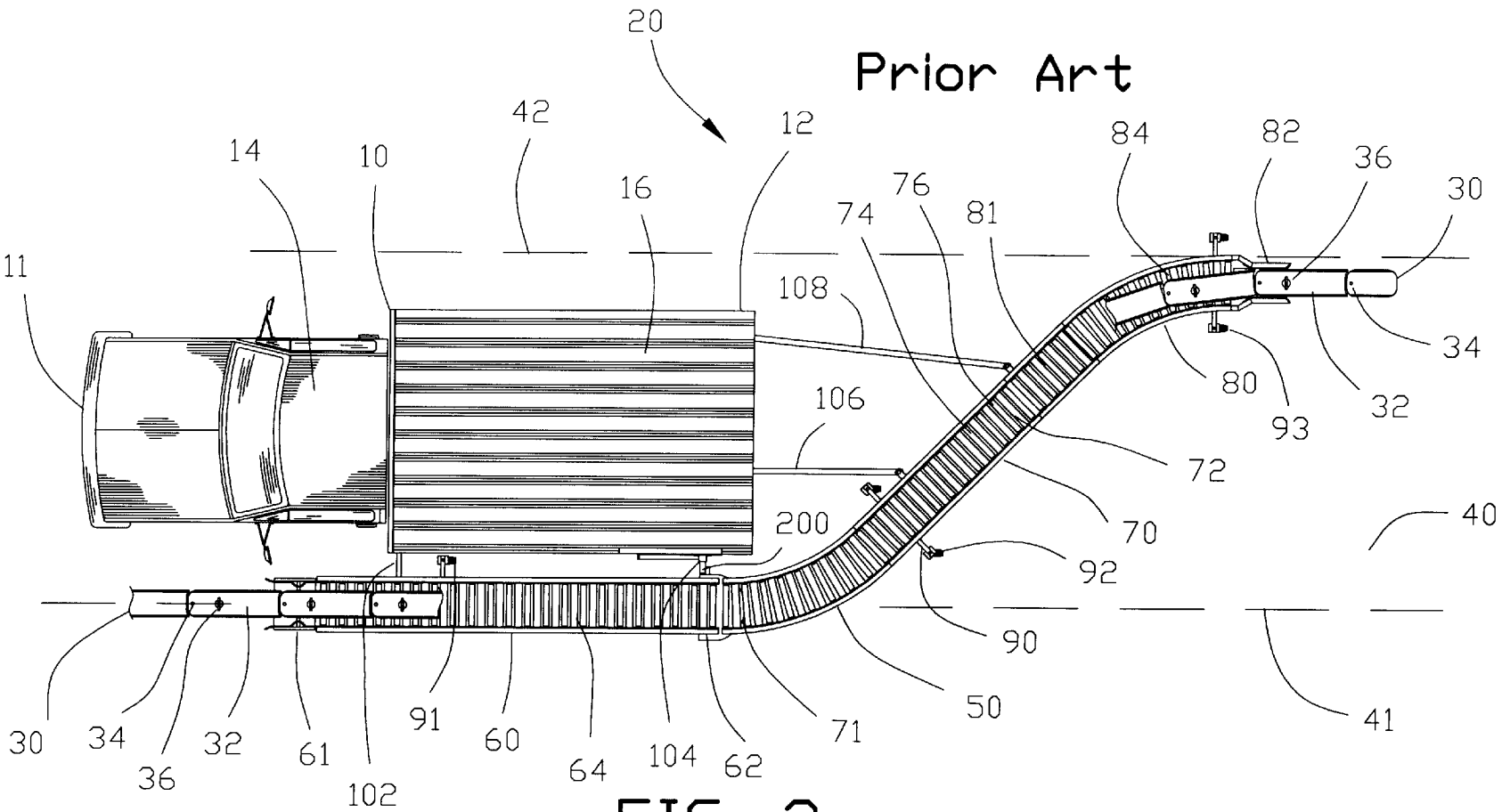
FIG. 3 is a top view of the prior art apparatus of FIG. 1 illustrating a more narrow lateral displacement of lane dividers than the lateral displacement illustrated in FIG. 2.

FIGS. 1–3 are side and top views of a vehicle 10 supporting an apparatus 20 of the prior art for laterally moving lane dividers 30 on a roadway 40. The vehicle 10 comprises a front end 11 and a rear end 12 with a cab 14 disposed in proximity to the front end 11 of the vehicle 10. A bed 16 is posed in proximity to the rear end 12 of the vehicle 10. Although the vehicle 10 has been shown as a flat bed truck, it should be appreciated by those skilled in the art that the apparatus 20 may be utilized with a wide variety of vehicles.

The lane dividers 30 are used to divide or direct vehicle traffic on the roadway 40. The lane dividers 30 comprises a plurality of divider sections 32 that are interconnected to one another in pivotal connections 34. The plurality of divider sections 32 may include vertical markers 36 affixed to the lane dividers 30 to enhance the visibility of the lane dividers 30 to the vehicle traffic.

The vehicle 10 is located on the roadway 40 between first and second lane markings 41 and 42 shown as lines painted on the roadway 40. The apparatus 20 laterally moves the lane dividers 30 from an initial position at the first lane marking 41 to a final position at the second lane marking 42 as the vehicle 10 moves forward on the road 40.

The apparatus 20 comprises a generally serpentine-shape conveyor 50 having a receiving segment 60, a translocating segment 70 and a discharge segment 80. The receiving segment 60 extends between an input end 61 and an output end 62 with a plurality of horizontally disposed rollers 64 for assisting the movement of the lane dividers 30 thereupon.

The translocating segment 70 extends between an input end 71 and an output end 72 with a plurality of horizontally disposed rollers 74 for assisting the movement of the lane dividers 30 thereupon. Preferably, the translocating segment 70 is composed of a plurality of sections 76 that are fixably attached to one another.

Similarly, the discharge segment 80 extends between any input end 81 and an output end 82 with a plurality of horizontally disposed rollers 84 for assisting the movement of the lane dividers 30 thereupon.

The output end 62 of the receiving segment 60 is connected to the input end 71 of the translocating segment 70. The output end 72 of the translocating segment 70 is connected to the input 81 of the discharge segment 80. The receiving segment 60, the translocating segment 70, and discharge segment 80 are fixably attached to one another to create the serpentine-shape conveyor 50.

A plurality of caster wheels 90 support the serpentine-shape conveyor 50 relative to the roadway 40. In this embodiment, the plurality of caster wheels 90 comprise a plurality of caster wheel pairs 91, 92 and 93 for respectively supporting the receiving segment 60, the translocating segment 70, and discharge segment 80 relative to the roadway 40.

A plurality of connectors 100 secure the serpentine-shape conveyor 50 to the vehicles 10. In this embodiment, plural side connectors 102 and 104 connect the receiving segments 60 to the vehicle 10. In addition, plural rear connectors 106 and 108 connect the translocating segment 70 to the vehicle 10. Accordingly, the serpentine-shape conveyor 50 maintains a rigid serpentine-shape with the serpentine-shape conveyor 50 being rigidly connected to the vehicle 10.

The forward movement of the vehicle 10 on the roadway 40 moves the lane dividers 30 into the input end 61 of the receiving segment 60. The rollers 64 transfer the lane dividers 30 to the translocating segment 70 for laterally displacing the lane dividers 30. The rollers 74 of the translocating segment 70 transfer the lane dividers 30 to the discharge segment 80. The lane dividers 30 are moved on the rollers 84 to be discharged from the output end 82 of the discharge segment 80. The lane dividers 30 are accordingly laterally displaced from the initial position at the first lane marking 41 to the final position at the second lane marking 42.

FIG. 2 is a top view of FIG. 1 illustrating a wide lateral displacement of lane dividers. The translocating segment 70 contains a greater plurality of sections 76 of the translocating segment 70 to provide the wide lateral displacement of lane dividers.

FIG. 3 is a top view of FIG. 1 illustrating a narrow lateral displacement of lane dividers. The translocating segment 70 contains a lesser plurality of sections 76 of the translocating segment 70 to provide the narrow lateral displacement of lane dividers.

The removal or the addition of a section 76 within the translocating segment 70 varies the amount of lateral displacement of the lane dividers 30 from the first lane marking 41 to the second lane marking 42.

The aforementioned apparatus 10 of the prior art functioned well but has certain disadvantages that are solved by the apparatus of the present invention. Firstly, the prior art apparatus tended to discharge the lane dividers 30 from the output end 82 of the discharge segment 80 in a twisted or warped manner. Accordingly, upon the translocation of the lane dividers 30 from the first lane marking 41 to the second lane marking 42, the lane dividers 30 on the second lane marking 42 had variations or wiggles from a straight line. If the apparatus 10 of the prior art was used in the opposite direction in the translocating of the lane dividers 30 from the second lane marking 42 to the first lane marking 41, the variation or wiggles from a straight line would be amplified by the second translocating process.

In many congested urban areas, the lane dividers 30 are changed on a roadway 40 several times a day for directing traffic inbound in the morning and for directing traffic outbound in the afternoon. Accordingly, the disadvantage of the variation or wiggles from a straight line in the translocating process created a significant problem in the prior art.

The second disadvantage of the aforementioned apparatus 10 of the prior art was the requirement of removing or adding one or more sections 76 to the translocating segment 70 to change the lateral displacement between the first lane marking 41 and the second lane marking 42. The removal or the addition of one or more sections 76 to the translocating segment 70 was a time-consuming process. The improved apparatus of the present invention solves these problems of the prior art apparatus 10.

Figure 4:
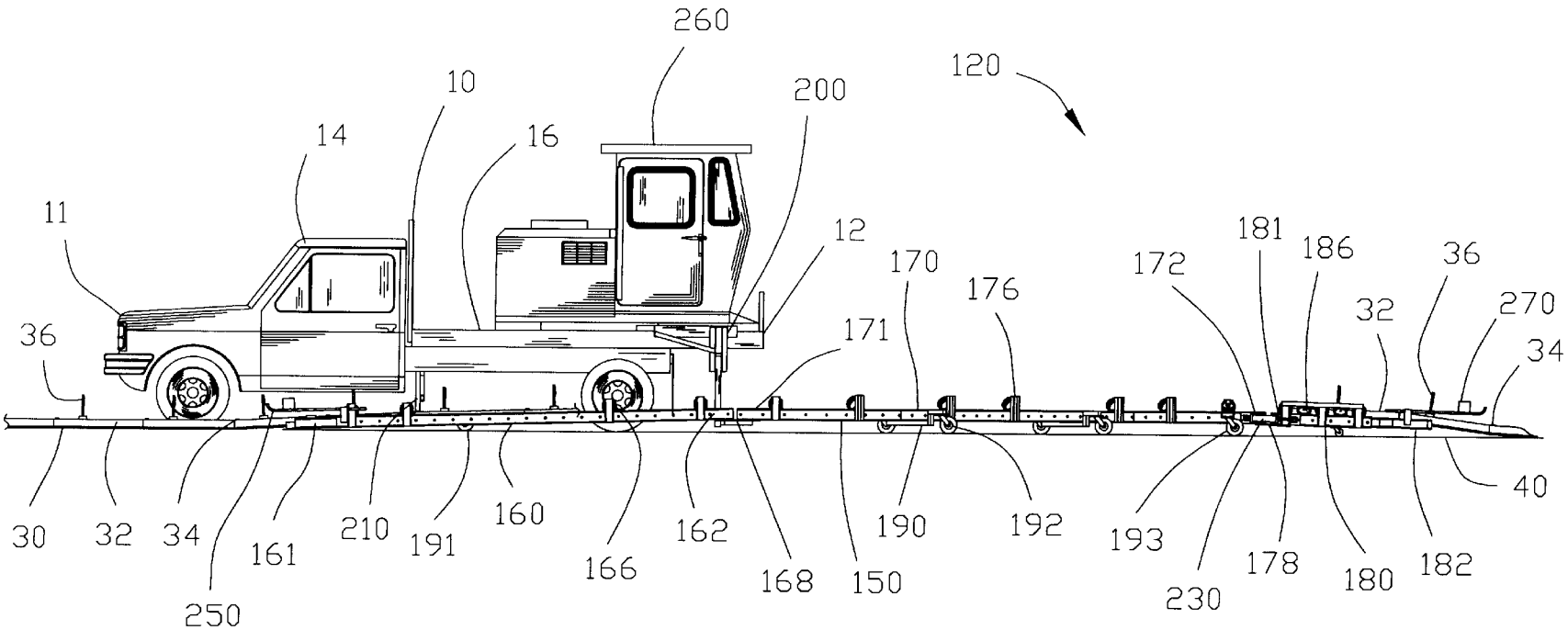
FIG. 4 is a side view of a first embodiment of the present invention illustrating an apparatus for laterally translocating lane dividers.
Figure 5:
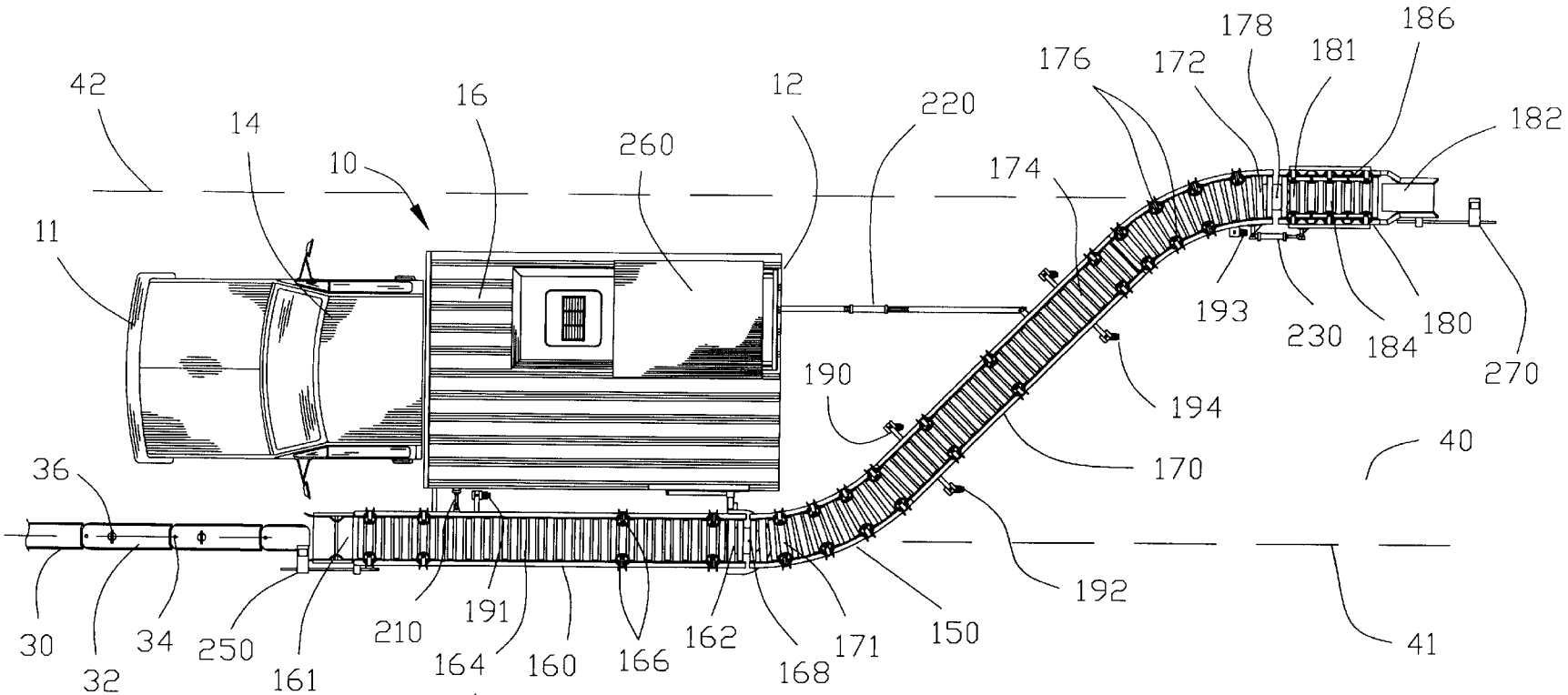
FIG. 5 is a top view of FIG. 4.

FIGS. 4 and 5 are side and top views of the apparatus 120 for laterally translocating the lane dividers 30 incorporating a first embodiment of the present invention. The apparatus 120 comprises a generally serpentine-shape conveyor 150 having a receiving segment 160, a translocating segment 170 and a discharge segment 180. The receiving segment 160 extends between an input end 161 and an output end 162. A plurality of horizontally disposed rollers 164 are located on the receiving segment 160. A plurality of angularly disposed rollers 166 are disposed on opposed sides of the plurality of horizontally disposed rollers 164. The plurality of horizontally disposed rollers 164 and the plurality of angularly disposed rollers 166 assisting the movement of the lane dividers 30 thereupon.

The translocating segment 170 extends between an input end 171 and an output end 172. A plurality of horizontally disposed rollers 174 are located on the translocating segment 170. A plurality of angularly disposed rollers 176 are disposed on opposed sides of the plurality of horizontally disposed rollers 174. The plurality of horizontally disposed rollers 174 and the plurality of angularly disposed rollers 176 assist in the movement of the lane dividers 30 thereupon.

Similarly, the discharge segment 180 extends between an input end 181 and an output end 182. A plurality of horizontally disposed rollers 184 are located on the discharge segment 180. A plurality of angularly disposed rollers 186 are disposed on opposed sides of the plurality of horizontally disposed rollers 184. The plurality of horizontally disposed rollers 184 and the plurality of angularly disposed rollers 186 assist in the movement of the lane dividers 30 thereupon.

The output end 162 of the receiving segment 160 is pivotably connected to the input end 171 of the translocating segment 170 by a first pivot 168. The output end 172 of the translocating segment 170 is pivotably connected to the input end 181 of the discharge segment 180 by a second pivot 178. The receiving segment 160, the translocating segment 170, and discharge segment 180 are pivotably attached to one another to create a variable serpentine-shape conveyor 150.

A plurality of caster wheels 190 support the serpentine-shape conveyor 150 relative to the roadway 40. In this embodiment, the plurality of caster wheels 190 comprise a plurality of caster wheel pairs 191, 192 and 193 for respectively supporting the receiving segment 160, the translocating segment 170, and discharge segment 180 relative to the roadway 40.

A connector 200 pivotably secures the pivotable intersection of the output end 162 of the receiving segment 160 and the input end 171 of the translocating segment 170 to the vehicles 10. In addition, a plurality of linear actuators connect the serpentine-shape conveyor 150 to the vehicles 10.

A receiving linear actuator 210 interconnects to the receiving segment 160 to the vehicles 10. A translocating linear actuator 220 interconnects to the translocating segment 170 to the vehicles 10. A discharge linear actuator 230 interconnects to the discharge segment 180 to the translocating segment 170. Although the linear actuators 210, 220 and 230 may take various forms, preferably, the linear actuators 210, 220 and 230 are hydraulic actuators incorporating hydraulic pistons located within hydraulic cylinders. Accordingly, the serpentine-shape conveyor 150 may be of various serpentine-shapes that are rigidly connected to the vehicle 10.

The forward movement of the vehicle 10 on the roadway 40 moves the lane dividers 30 into the input end 161 of the receiving segment 160. The rollers 164 and 166 transfer the lane dividers 30 to the translocating segment for 170 for laterally displacing the lane dividers 30. The rollers 174 and 176 of the translocating segment 170 transfer the lane dividers 30 to the discharge segment 180. The lane dividers 30 are moved on rollers 184 and 186 to be discharged from the output end 182 of the discharge segment 180. The lane dividers 30 are accordingly laterally displaced from the initial position at the first lane marking 41 to the final position at the second marking 42.

Figure 6:
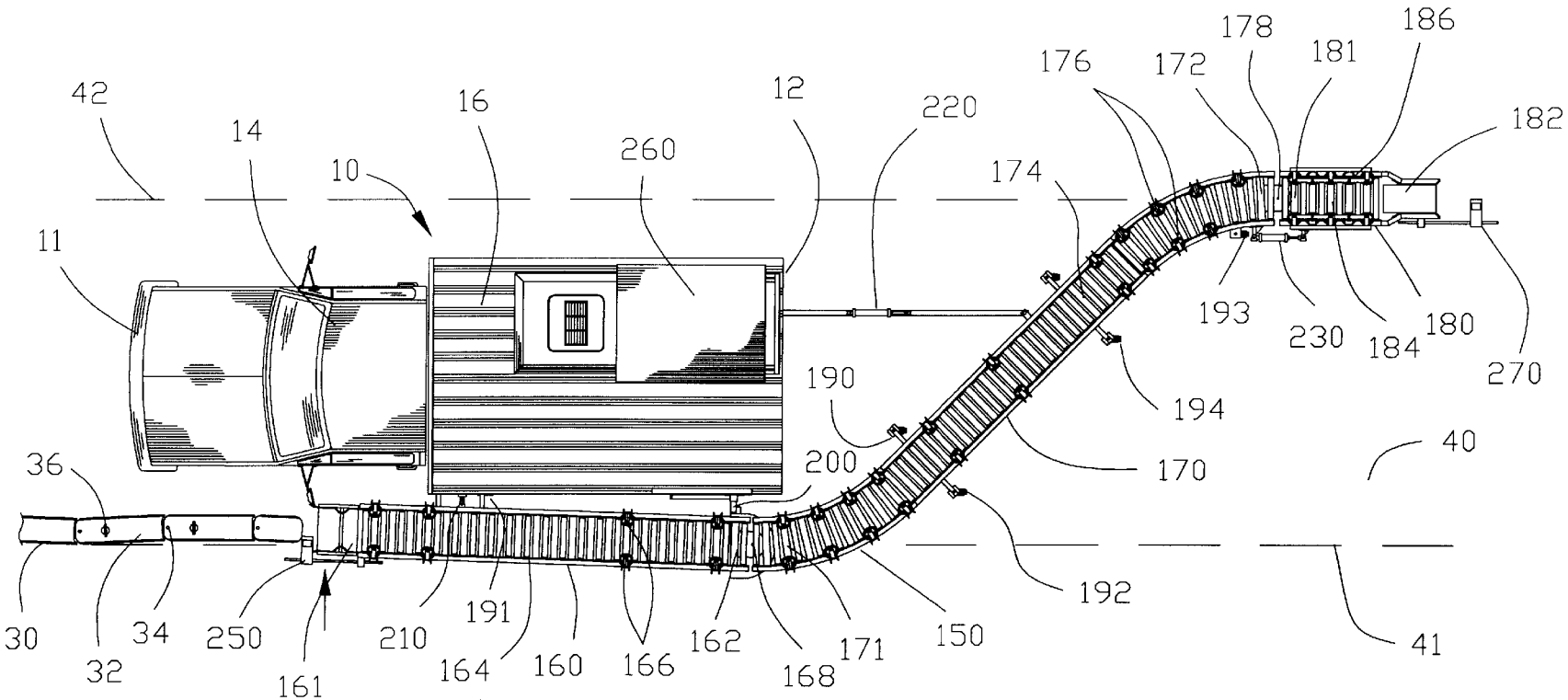
FIG. 6 is a top view of FIG. 4 illustrating a first pivoting of the lane receiving segment of a conveyor with respect to the vehicle.

FIG. 6 is a top view similar to FIG. 5 of the apparatus 120 of the present invention illustrating pivoting the receiving segment 160 of the serpentine-shaped conveyor 150 with respect to the translocating segment 170 of the serpentine-shaped conveyor 150 towards the vehicle 10. An inward movement of the receiving linear actuator 210 pivots the receiving segment 160 about the first pivot 168 towards the vehicle 10.

Figure 7:
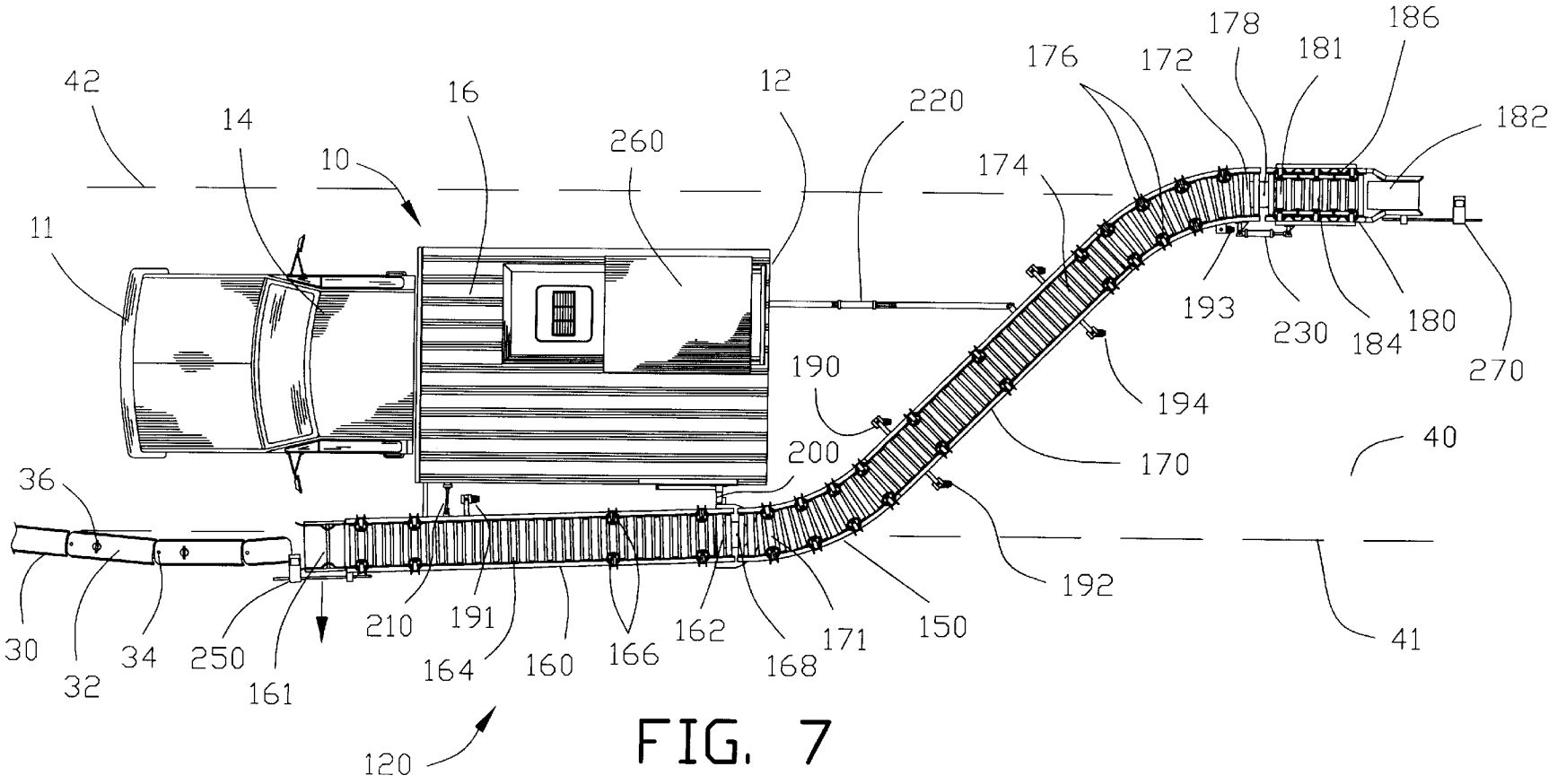
FIG. 7 is a top view of FIG. 4 illustrating a second pivoting of the lane receiving segment of the conveyor with respect to the vehicle.

FIG. 7 is a top view similar to FIG. 5 of the apparatus 120 of the present invention illustrating pivoting the receiving segment 160 of the serpentine-shaped conveyor 150 with respect to the translocating segment 170 of the serpentine-shaped conveyor 150 away from the vehicle 10. An outward movement of the receiving linear actuator 210 pivots the receiving segment 160 about the first pivot 168 away from the vehicle 10.

The receiving linear actuator 210 may be manually actuated by an operator to guide the input end 161 of the receiving segment 160 into proper alignment with the lane dividers 30. In the alternative, a receiving sensor 250 may be positioned in proximity to the input end 161 of the receiving segment 160 for sensing the position of the lane dividers 30. The receiving sensor 250 is connected to a controller 260 for controlling the receiving linear actuator 210.

As the vehicle 10 moves forward, the receiving sensor 250 senses the position of the lane dividers 30 relative to the input end 161 of the receiving segment 160. The controller 260 automatically actuates the receiving linear actuator 210 to move the input end 161 of the receiving segment 160 into proper alignment with the lane dividers 30. Accordingly, the operator of the vehicle 10 is not required to make minute adjustments in the direction of the vehicle 10 to compensate for small variations in the initial position of the lane dividers 30 on the road 40.

Figure 8:
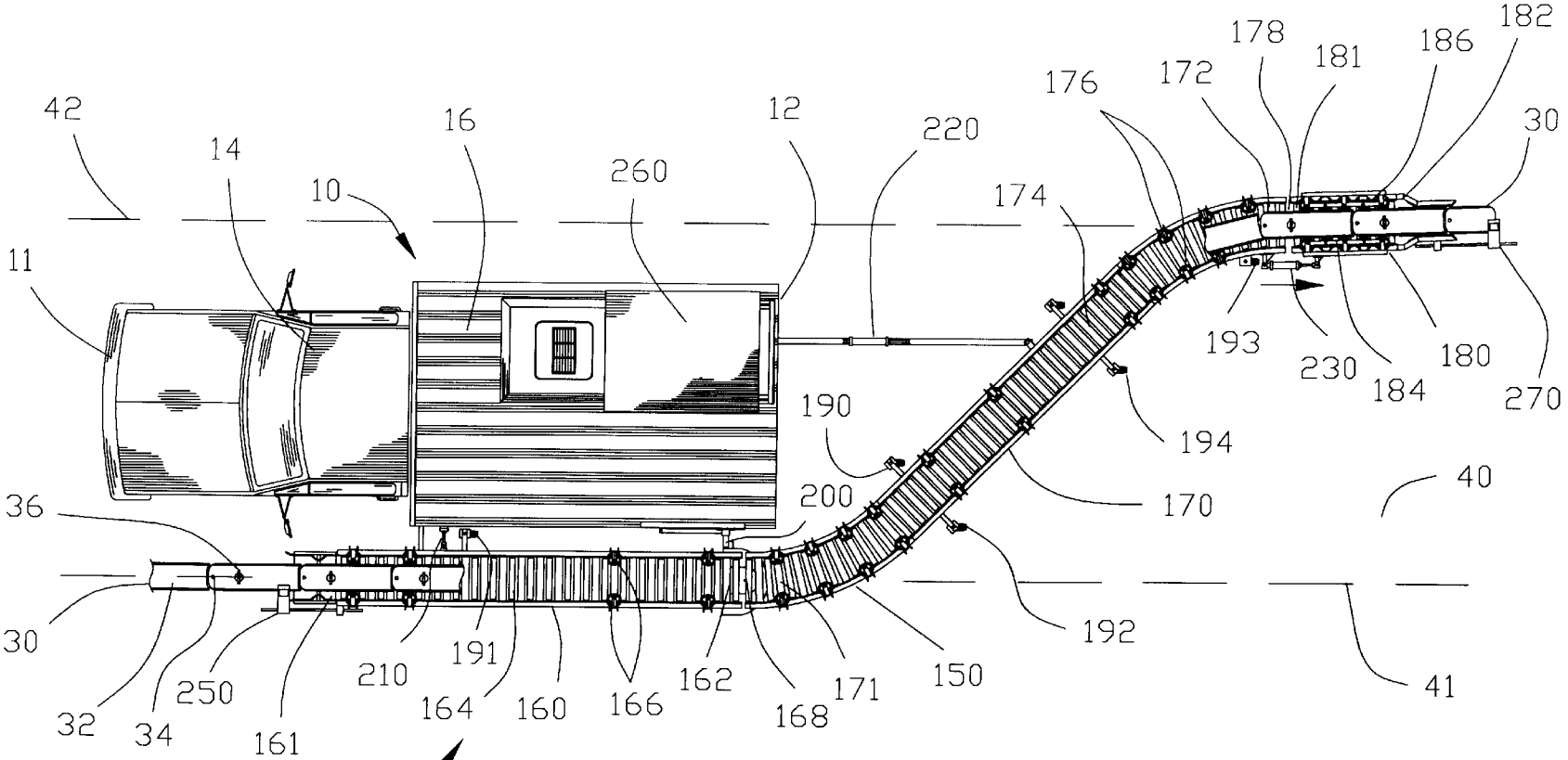
FIG. 8 is a top view of FIG. 4 illustrating a first pivoting of the lane discharging segment of the conveyor with respect to the vehicle.

FIG. 8 is a top view similar to FIG. 5 of the apparatus 120 of the present invention illustrating pivoting the discharge segment 180 of the serpentine-shaped conveyor 150 with respect to the translocating segment 170 of the serpentine-shaped conveyor 150 away from the vehicle 10. An outward movement of the discharge linear actuator 230 pivots the discharge segment 180 about the second pivot 178 away from the vehicle 10.

Figure 9:
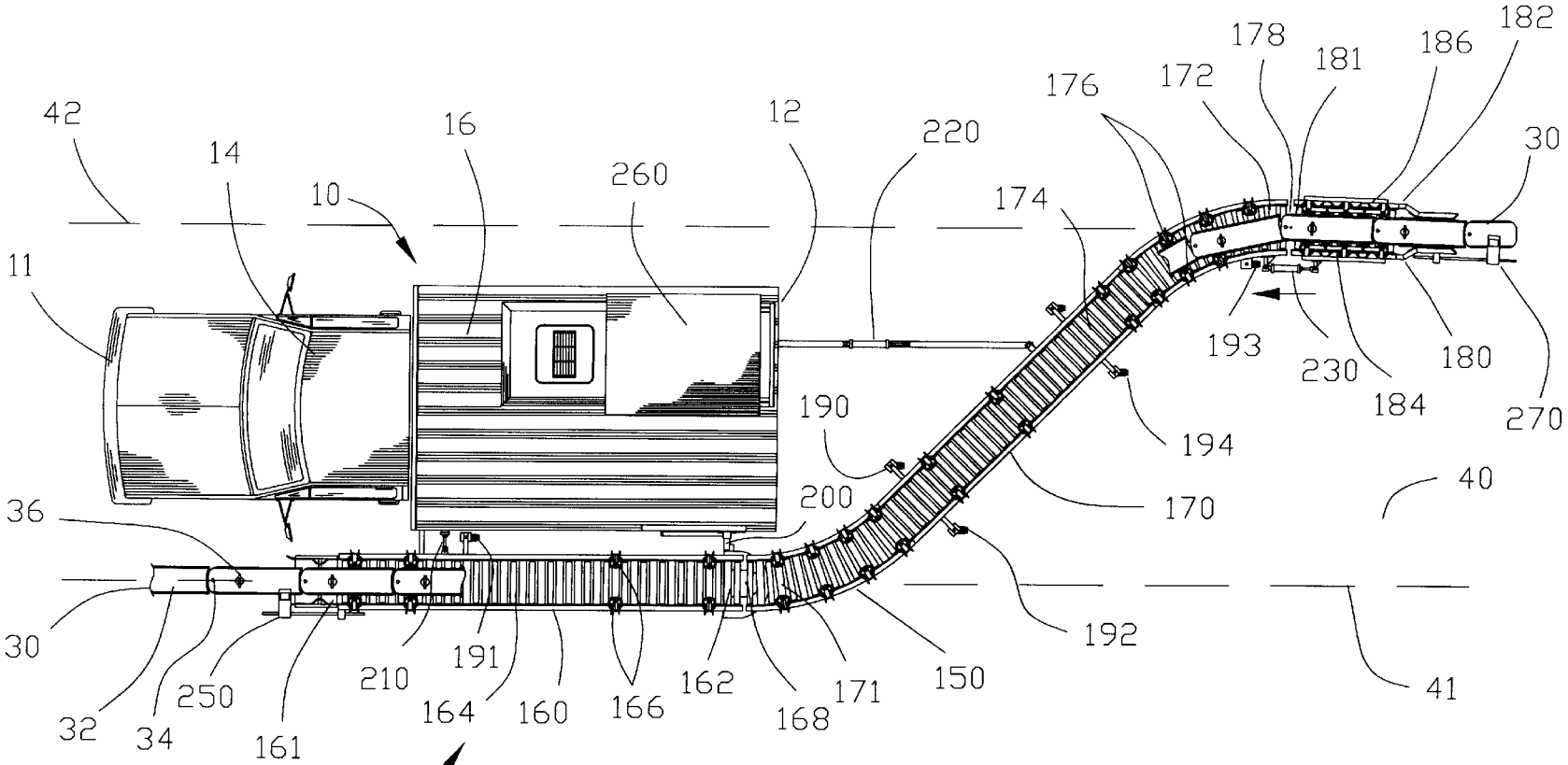
FIG. 9 is a top view of FIG. 4 illustrating a second pivoting of the lane discharging segment of the conveyor with respect to the vehicle.

FIG. 9 is a top view similar to FIG. 5 of the apparatus 120 of the present invention illustrating pivoting the discharge segment 180 of the serpentine-shaped conveyor 150 with respect to the translocating segment 170 of the serpentine-shaped conveyor 150 toward the vehicle 10. An inward movement of the discharge linear actuator 230 pivots the discharge segment 180 about the second pivot 178 toward the vehicle 10.

The discharge linear actuator 230 may be manually actuated by an operator to guide the output end 182 of the discharge segment 180 into proper alignment with the second lane marking 42 of the roadway 40. An operator (not shown) may be positioned with the bed 16 of the vehicle 10 for manually actuating the output end 182 of the discharge segment 180. In the alternative, a discharge sensor 270 may be positioned in proximity to the output end 182 of the discharge segment 180 for sensing the position of the second lane marking 42 on the roadway 40. The discharge sensor 270 is connected to the controller 260 for controlling the discharge linear actuator 230.

As the vehicle 10 moves forward, the discharge sensor 270 senses the position of the second lane marking 42 on the roadway 40 relative to the output end 182 of the discharge segment 180. The controller 260 automatically actuates the discharge linear actuator 230 to move the output end 182 of the discharge segment 180 into proper alignment with the second lane marking 42 of the roadway 40. Accordingly, an operator is not required to make minute adjustments in the output end 182 of the discharge segment 180 to properly align the lane dividers 30 with the second lane marking 42 of the roadway 40.

Figure 10:
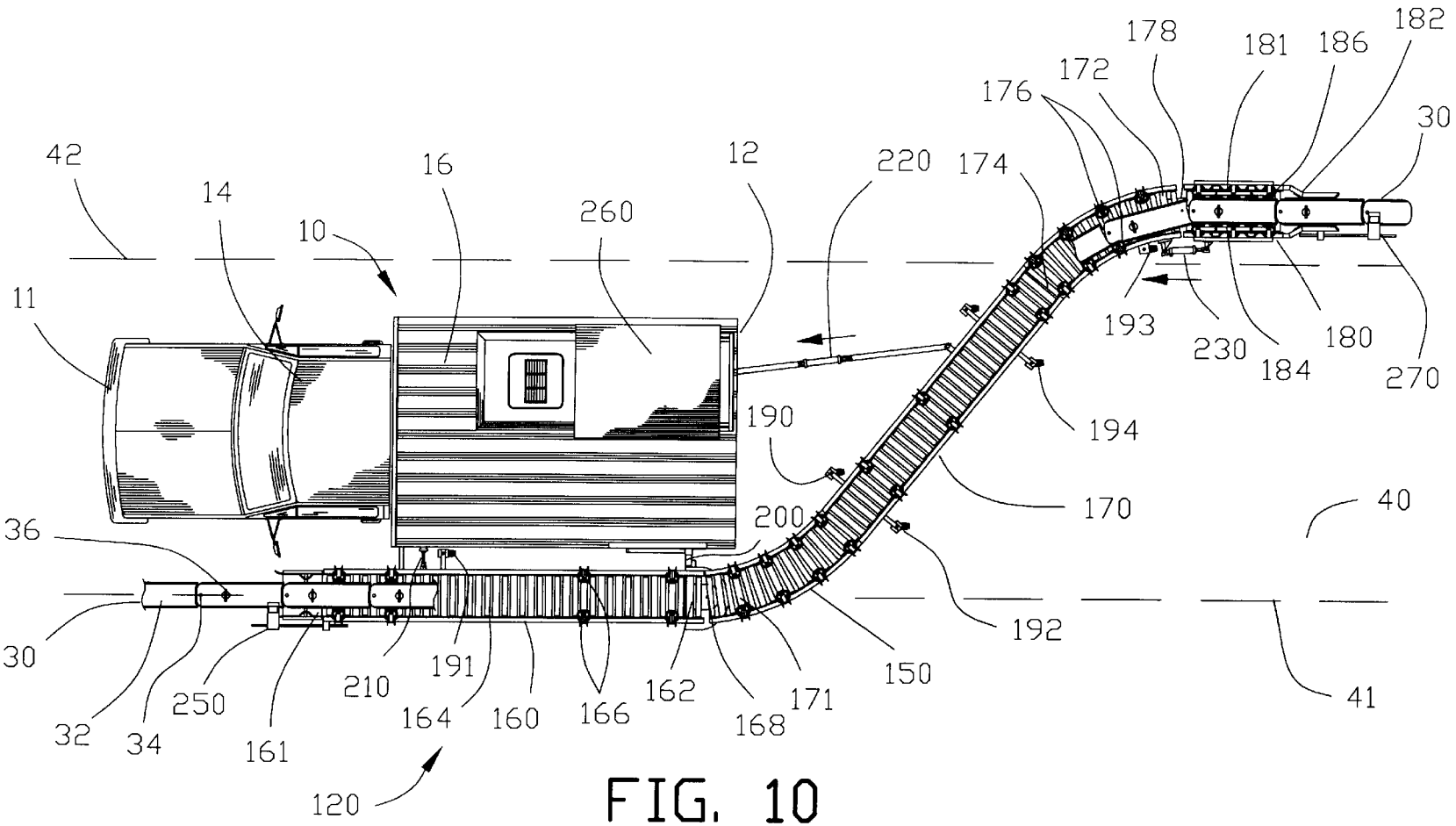
FIG. 10 is a top view of FIG. 4 illustrating a first pivoting of a translocation segment and the discharging segment of the conveyor for increasing the lateral displacement of the lane dividers from the initial lane position relative to the final lane position.

FIG. 10 is a top view similar to FIG. 5 of the apparatus 120 of the present invention illustrating pivoting the translocation segment 170 and the discharging segment 180 of the serpentine-shaped conveyor 150 for increasing the lateral displacement of the lane dividers 30 from the first lane marking 41 to the second marking 42. An inward movement of the discharge linear actuator 230 with an inward movement of the translocation segment 170 increases the lateral displacement of the lane dividers 30 from the first lane marking 41 to the second marking 42. The translocation segment 170 pivots about the first pivot 168 whereas the discharging segment 180 pivots about the second pivot 178.

Figure 11:
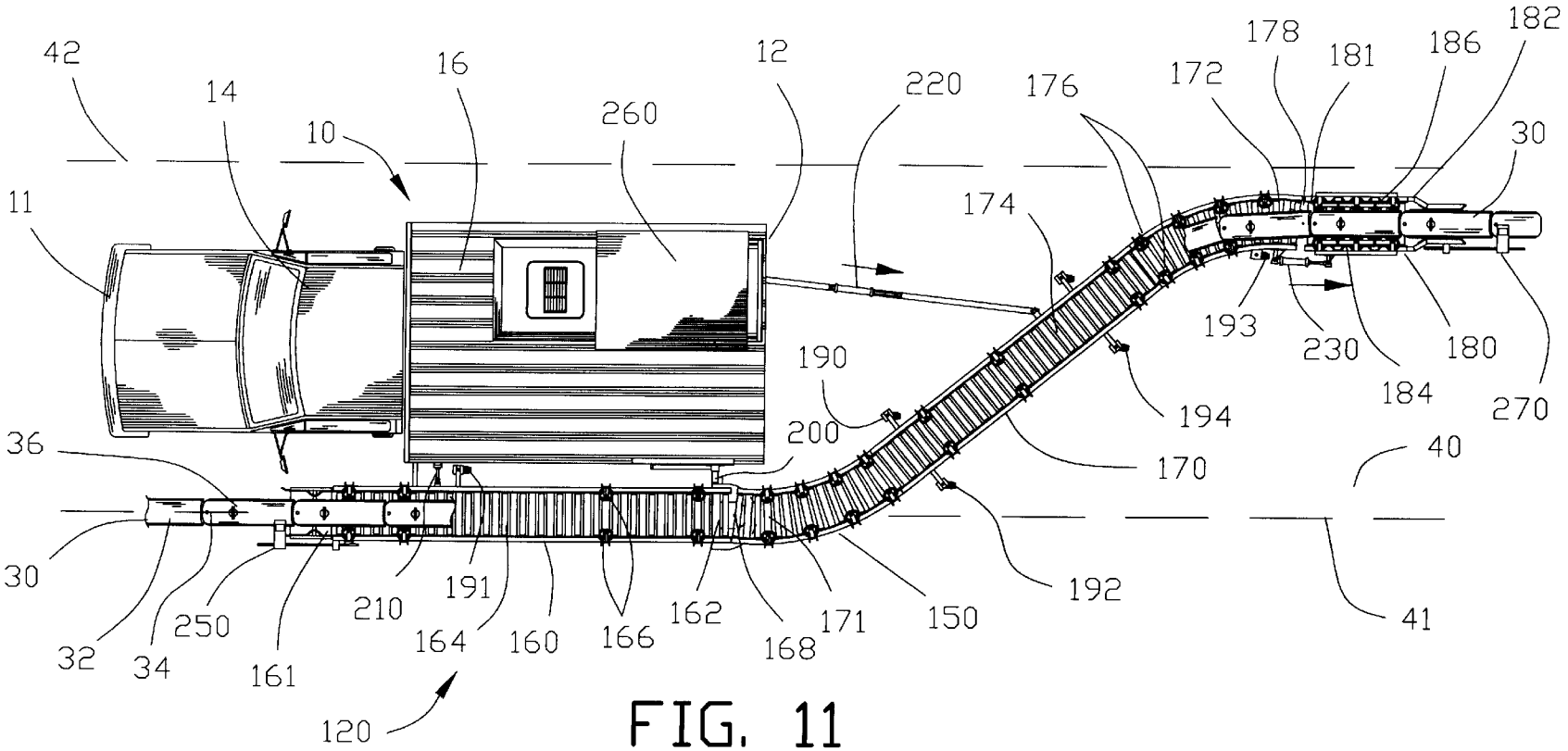
FIG. 11 is a top view of FIG. 4 illustrating a first pivoting of a translocation segment and the discharging segment of the conveyor for decreasing the lateral displacement of the lane dividers from the initial lane position relative to the final lane position.

FIG. 11 is a top view similar to FIG. 5 of the apparatus 120 of the present invention illustrating pivoting the translocation segment 170 and the discharging segment 180 of the serpentine-shaped conveyor 150 for decreasing the lateral displacement of the lane dividers 30 from the first lane marking 41 to the second marking 42. An outward movement of the discharge linear actuator 230 with an outward movement of the translocation segment 170 decreases the lateral displacement of the lane dividers 30 from the first lane marking 41 to the second marking 42. The translocation segment 170 pivots about the first pivot 168 whereas the discharging segment 180 pivots about the second pivot 178.

The present invention solves the problems of the prior art apparatuses for laterally displacing of lane dividers. The present invention provides an apparatus that accurately laterally translocates a lane divider from the initial position to the final position on the roadway. The apparatus automatically translocates the lane divider without the use of excessive and costly manual labor. Furthermore, the apparatus laterally translocates a lane divider without occupying an oncoming lane during the operation of the vehicle. The first embodiment of the invention enables the lane divider to be moved from an initial position to a final position on a roadway wherein the final position is displaced at least one lane relative to the initial position on the roadway. The pivoting of the translocation segment 170 varies the lateral displacement of the lane dividers 30 from the first lane marking 41 to the second marking 42. The pivoting of the translocation segment 170 eliminates the need of removing or adding one or more sections 76 to the translocating segment 70 to change the lateral displacement between the first lane marking 41 and the second lane marking 42 as required by the prior Art Apparatus of FIGS. 1–3.

Figure 12:
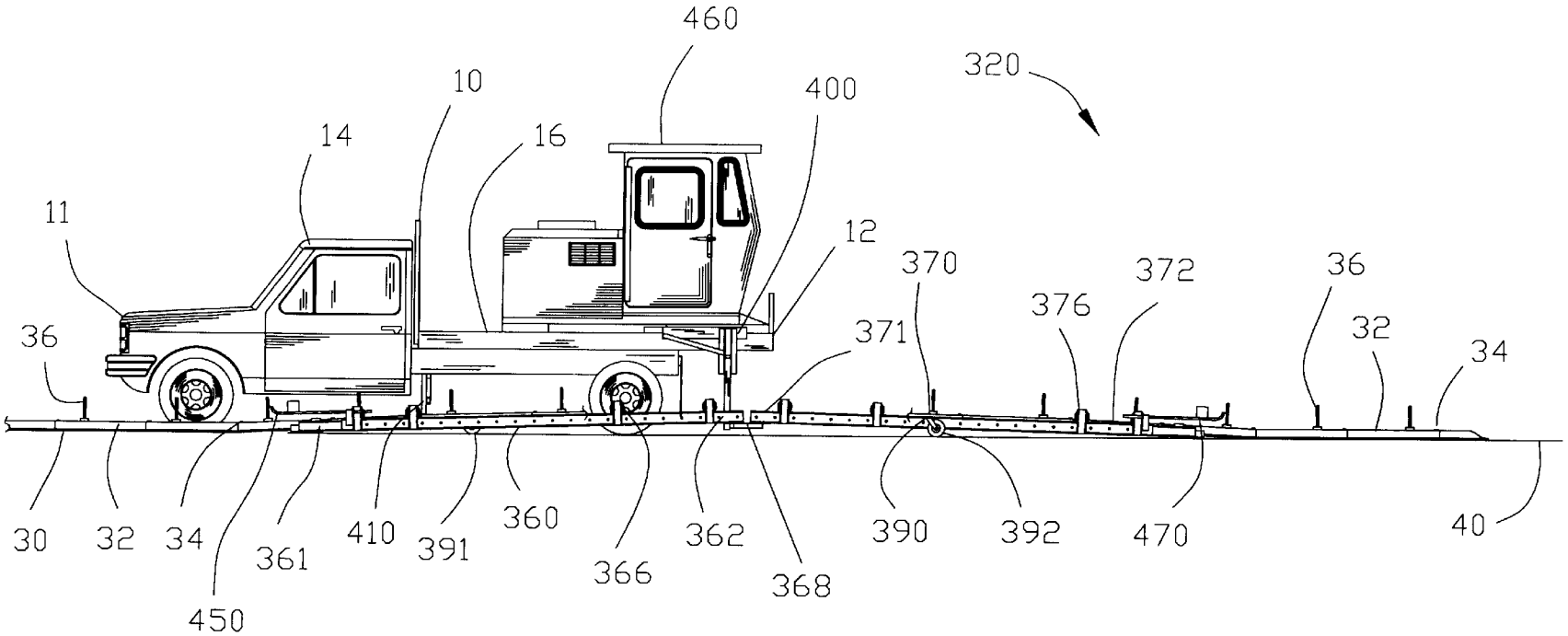
FIG. 12 is a side view of a second embodiment of the present invention illustrating an apparatus for adjusting the location of lane dividers.
Figure 13:
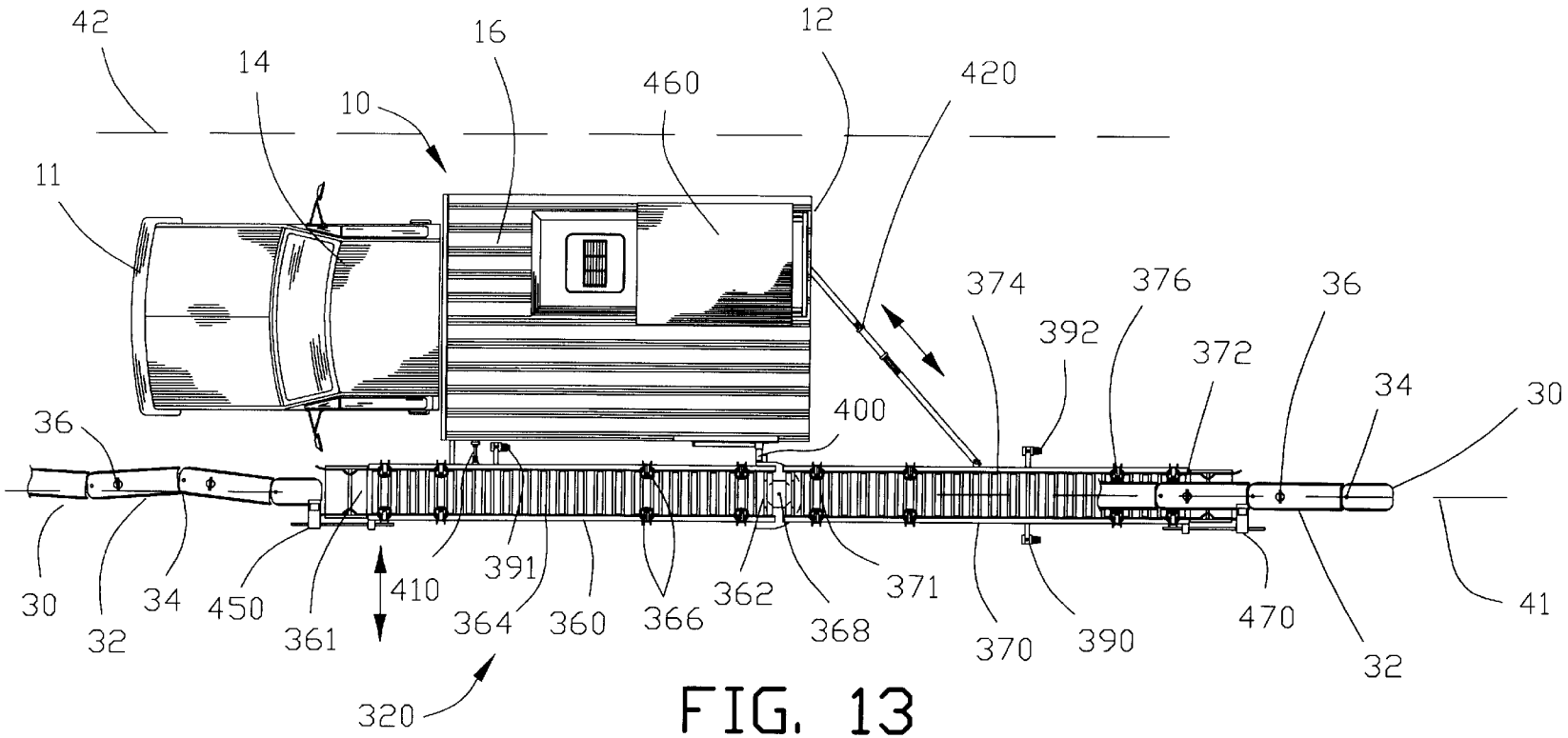
FIG. 13 is a top view of FIG. 12 illustrating the pivoting of the lane receiving segment and the pivoting of the lane discharging segment of the conveyor with respect to the vehicle.

FIGS. 12 and 13 are side and top views of the apparatus 320 for laterally translocating the lane dividers 30 incorporating a second embodiment of the present invention. The apparatus 320 comprises a generally linear conveyor 350 having a receiving segment 360 and a discharge segment 380. The receiving segment 360 extends between an input end 361 and an output end 362. A plurality of horizontally disposed rollers 364 are located on the receiving segment 360. A plurality of angularly disposed rollers 366 are disposed on opposed sides of the plurality of horizontally disposed rollers 364.

The discharge segment 380 extends between an input end 381 and an output end 382. A plurality of horizontally disposed rollers 384 are located on the discharge segment 380. A plurality of angularly disposed rollers 386 are disposed on opposed sides of the plurality of horizontally disposed rollers 384.

The output end 362 of the receiving segment 360 is pivotably connected to the input end 381 of the discharge segment 180 by a first pivot 368. The receiving segment 360 and the discharge segment 380 are pivotably attached to one another to create a variable linear conveyor 350.

A plurality of caster wheels 390 support the linear conveyor 350 relative to the roadway 40. In this embodiment, the plurality of caster wheels 390 comprise a plurality of caster wheel pairs 391 and 392 for respectively supporting the receiving segment 360 and the discharge segment 380 relative to the roadway 40.

A connector 400 pivotably secures the pivotable intersection of the output end 362 of the receiving segment 360 and the input end 381 of the discharge segment 380 to the vehicles 10. In addition, a plurality of linear actuators connect the linear conveyor 350 to the vehicles 10.

A receiving linear actuator 410 interconnects to the receiving segment 360 to the vehicles 10. A discharge linear actuator 420 interconnects to the discharge segment 380 to the vehicles 10. Accordingly, the linear conveyor 350 may be bent into various shapes that are rigidly connected to the vehicle 10.

The forward movement of the vehicle 10 on the roadway 40 moves the lane dividers 30 into the input end 361 of the receiving segment 360. The rollers 364 and 366 transfer the lane dividers 30 to the discharge segment for 380 for aligning the lane dividers 30. The rollers 384 and 386 of the discharge segment 370 transfer the lane dividers 30 to be discharged from the output end 382 of the discharge segment 380. The lane dividers 30 are aligned from the initial position at the first lane marking 41 to the final aligned position at the first marking 41.

FIG. 13 illustrates the pivoting of the receiving segment 360 of the linear conveyor 350 towards and away from the vehicle 10. An inward and an outward movement of the receiving linear actuator 410 pivots the receiving segment 360 about the first pivot 368 towards and away from the vehicle 10 as illustrated by the arrows and in a manner similar to FIGS. 6 and 7.

The receiving linear actuator 410 may be manually actuated by an operator to guide the input end 361 of the receiving segment 360 into proper alignment with the lane dividers 30. In the alternative, a receiving sensor 450 may be positioned in proximity to the input end 361 of the receiving segment 360 for sensing the position of the lane dividers 30 and for controlling the receiving linear actuator 410.

As the vehicle 10 moves forward, the receiving sensor 450 senses the position of the lane dividers 30 relative to the input end 361 of the receiving segment 360. The controller 460 automatically actuates the receiving linear actuator 410 to move the input end 361 of the receiving segment 360 into proper alignment with the lane dividers 30.

FIG. 13 illustrates the pivoting of the discharge segment 380 of the linear conveyor 350 towards and away from the vehicle 10. An inward and an outward movement of the discharge linear actuator 420 pivots the discharge segment 380 about the first pivot 368 towards and away from the vehicle 10 as illustrated by the arrows and in a manner similar to FIGS. 8 and 9.

The discharge linear actuator 420 may be manually actuated by an operator to guide the output end 382 of the discharge segment 380 into proper alignment with the first lane marking 41 of the roadway 40. In the alternative, a discharge sensor 470 may be positioned in proximity to the output end 382 of the discharge segment 380 for sensing the position of the first lane marking 41 on the roadway 40 and for controlling the discharge linear actuator 420.

The second embodiment of the present invention shown in FIG. 13 provides an apparatus 320 for laterally translocating the lane divider 30 from an initial position 41 to final position 41 on a roadway 40 wherein the final position 41 is aligned in the same lane as the initial position on the roadway 40. The second embodiment of the present invention provides an apparatus for aligning misaligned lane dividers 30 on a roadway 40.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for translocating a lane divider from an initial position to a final position on a roadway upon the movement of a vehicle, comprising:

a conveyor connected to the vehicle;

said conveyor including a receiving segment for receiving the lane divider from the initial position on the roadway and a discharging segment for discharging the lane divider to the final position on the roadway;

said receiving segment and the discharging segment being pivotally connected relative to the vehicle;

said receiving segment being pivotable for enabling lateral movement of the receiving segment to accommodate for variation in the initial position of the lane divider on the roadway; and said discharging segment being pivotable for enabling the discharge of the lane divider to a final position aligned on the roadway.

2. An apparatus for translocating a lane divider as set forth in claim 1, wherein said discharging segment is pivoted for discharging the lane divider to a final position aligned in the same lane as the initial position on the roadway.

3. An apparatus for translocating a lane divider as set forth in claim 1, including a translocating segment interposed between said receiving segment and said discharging segment for moving the lane divider from one lane to another lane on the roadway.

4. An apparatus for translocating a lane divider as set forth in claim 1, including a translocating segment interposed between said receiving segment and said discharging segment for moving the lane divider from one lane to another lane on the roadway; and said lateral translocation of the lane divider from the initial position to the final position on a roadway being displaced at least one lane relative to the initial position on the roadway.

5. An apparatus for translocating a lane divider as set forth in claim 1, wherein said conveyor further comprises a plurality of spaced rollers for assisting the transporting of the lane divider along said conveyor.

6. An apparatus for translocating a lane divider as set forth in claim 1, wherein said conveyor comprises a bottom and two sides; and a plurality of spaced rollers located on said bottom and said sides of said conveyor for assisting the transporting of the lane divider along said conveyor.

7. An apparatus for translocating a lane divider as set forth in claim 1, including a pivot assembly for pivoting said receiving segment relative to the vehicle for receiving the lane divider from the initial position on the roadway.

8. An apparatus for translocating a lane divider as set forth in claim 1, including a pivot assembly for pivoting said receiving segment relative to the vehicle for receiving the lane divider from the initial position on the roadway;

said pivot assembly including an optical sensor for sensing the location of the lane divider relative to said receiving segment and for pivoting said receiving segment relative to said vehicle for establishing proper alignment with the lane divider.

9. An apparatus for translocating a lane divider as set forth in claim 1, including a pivot assembly for pivoting said discharge segment relative to the vehicle for discharging the lane divider to a final position on the roadway.

10. An apparatus for translocating a lane divider as set forth in claim 1, including a pivot assembly for pivoting said discharging segment relative to the vehicle for discharging the lane divider onto the final position on the roadway;

said pivot assembly including an optical sensor for sensing the location of the lane divider relative to said receiving segment and for pivoting said discharging segment relative to said vehicle for establishing proper alignment with the lane divider.

11. An apparatus for translocating a lane divider from an initial position to a final position on a roadway upon the movement of a vehicle, comprising:

a conveyor connected to the vehicle;

said conveyor including a receiving segment, a translocating segment and a discharging segment;

said receiving segment receiving the lane divider from the initial position on the roadway;

said translocating segment laterally moving the lane divider;

said discharging segment discharging the lane divider to the final position on the roadway; and one of said receiving segment and the discharging segment being pivotally connected relative to the vehicle for accommodating for variation in the initial position of the lane divider on the roadway to enable the discharge of the lane divider to the final position on the roadway.

12. An apparatus for translocating a lane divider as set forth in claim 11, wherein said receiving segment is pivotally connected relative to the vehicle;

said receiving segment being pivotable for enabling lateral movement of the receiving segment to accommodate for variation in the initial position of the lane divider on the roadway.

13. An apparatus for translocating a lane divider as set forth in claim 11, wherein said discharging segment is pivotable for enabling the discharge of the lane divider to a final position on the roadway.

14. An apparatus for translocating a lane divider as set forth in claim 11, wherein said translocating segment is pivotally connected relative to the vehicle;

said translocating segment being pivotable for varying said lateral movement of the lane divider for adjusting for a width between a first lane divider and a second lane divider.

15. An apparatus for translocating a lane divider from an initial position to a final position on a roadway upon the movement of a vehicle, comprising:

a generally serpentine-shaped conveyor including a receiving segment for receiving the lane divider from the initial position on the roadway;

a discharging segment for discharging the lane divider to a final position on the roadway;

a translocating segment for connecting said receiving and discharging segments;

said receiving segment and said translocating segment being pivotally connected to one another so as to enable the lateral movement of the conveyor receiving segment to accommodate for variation in the positioning of the lane divider and allow for the centered receipt of the lane divider onto the receiving segment; and means for connecting the conveyor to a vehicle.

16. The apparatus for laterally translocating a lane divider from one position on a roadway to another as set forth in claim 15, wherein the translocating segment and discharging segment are pivotally connected to allow greater precision in discharging the lane divider.

17. The apparatus for translocating a lane divider from one position on a roadway to another as set forth in claim 15, further comprising a translocating member pivot assembly for pivoting the translocating segment of the conveyor with respect to the receiving and discharge segments so as to control the distance of the lane divider lateral translocation.

18. The apparatus for laterally translocating a lane divider from one position on a roadway to another as set forth in claim 15, wherein said conveyor further comprises a plurality of spaced rollers for assisting the transporting of the lane divider along said conveyor.

19. The apparatus for laterally translocating a lane divider as set forth in claim 15, wherein said conveyor comprises a bottom and two sides;

a plurality of spaced rollers located on said bottom and said sides of said conveyor for assisting the transporting of the lane divider along said conveyor.

* * * * *